United States Patent [19]

Verity

[11] Patent Number: 4,776,990

[45] Date of Patent: Oct. 11, 1988

[54] METHOD AND APPARATUS FOR NEBULIZING A LIQUID

[75] Inventor: Nigel Verity, Dorval, Canada

[73] Assignee: Rhinotherm Netzer Sereni, Kibbutz Netzer Sereni, Israel

[21] Appl. No.: 95,734

[22] Filed: Sep. 14, 1987

Related U.S. Application Data

[63] Continuation-in-part of Ser. No. 890,037, Jul. 28, 1986, abandoned.

[30] Foreign Application Priority Data

Nov. 14, 1986 [IL] Israel ..... 80635

[51] Int. Cl.[4] ..... B01F 3/04

[52] U.S. Cl. ..... 261/128; 261/30; 261/81; 261/130; 261/DIG. 48; 261/142; 239/102.2; 128/200.16

[58] Field of Search ..... 239/102.2; 261/DIG. 48, 261/142, 128, 130, 30, 81; 128/200.16

[56] References Cited

U.S. PATENT DOCUMENTS

| | | | |
|---|---|---|---|
| 3,387,607 | 6/1968 | Gauthier et al. | 239/102.2 |
| 3,469,785 | 9/1969 | Boucher et al. | 261/DIG. 48 |
| 3,490,697 | 1/1970 | Best, Jr. | 128/200.16 |
| 3,561,444 | 2/1971 | Boucher | 128/200.16 |
| 3,565,072 | 2/1971 | Gauthier | 128/200.16 |
| 3,593,712 | 7/1971 | Weaver et al. | 128/200.16 |
| 3,690,317 | 9/1972 | Millman | 128/200.16 |
| 3,788,543 | 1/1974 | St. Amand et al. | 239/102.2 |
| 3,812,854 | 5/1974 | Michaels et al. | 239/102.2 |
| 3,901,443 | 8/1975 | Mitsui et al. | 261/DIG. 48 |
| 3,989,042 | 11/1976 | Mitsui et al. | 261/DIG. 48 |
| 4,031,171 | 6/1977 | Asao et al. | 261/DIG. 48 |
| 4,369,777 | 1/1983 | Lwoff | 128/200.16 |
| 4,401,114 | 8/1983 | Lwoff et al. | 128/200.14 |
| 4,410,139 | 10/1983 | Nishikawa et al. | 261/DIG. 48 |
| 4,563,313 | 1/1986 | Tsuaki | 261/DIG. 48 |
| 4,640,804 | 2/1987 | Mizoguchi | 261/DIG. 48 |

FOREIGN PATENT DOCUMENTS

| | | | |
|---|---|---|---|
| 3049244 | 7/1982 | Fed. Rep. of Germany | 128/200.16 |
| 54-68040 | 5/1979 | Japan | 261/DIG. 48 |
| 54-134832 | 10/1979 | Japan | 239/102.2 |
| 56-59142 | 5/1981 | Japan | 261/DIG. 48 |
| 60-117039 | 6/1985 | Japan | 261/DIG. 48 |

*Primary Examiner*—Tim Miles

*Attorney, Agent, or Firm*—Benjamin J. Barish

[57] ABSTRACT

A method and apparatus for nebulizing a liquid by operating an ultrasonic generator while submerged in a pool of the liquid to be nebulized to produce a spout of intensely-agitated liquid spouting upwardly out of the surface of the liquid pool. A jet of heated gas is directed to impinge the spout at an angle to the spout axis and with sufficiently high velocity to deflect the upper portion of the spout laterally of its base at the liquid level and thereby to impart an arcuate trajectory to the spout. The rate of nebulization from the spout is thus increased by: (a) the increased area of contact of the spout, because of its arcuate trajectory, with the gas in the jet; (b) the increased rate of contact of the spout with the gas in the jet because of its high velocity; and (c) the reduced disturbance to the formation of the spout at the spout base because of the shifting laterally with respect to the spout base of the fall-back into the pool of larger liquid droplets from the spout.

18 Claims, 3 Drawing Sheets

FIG.1
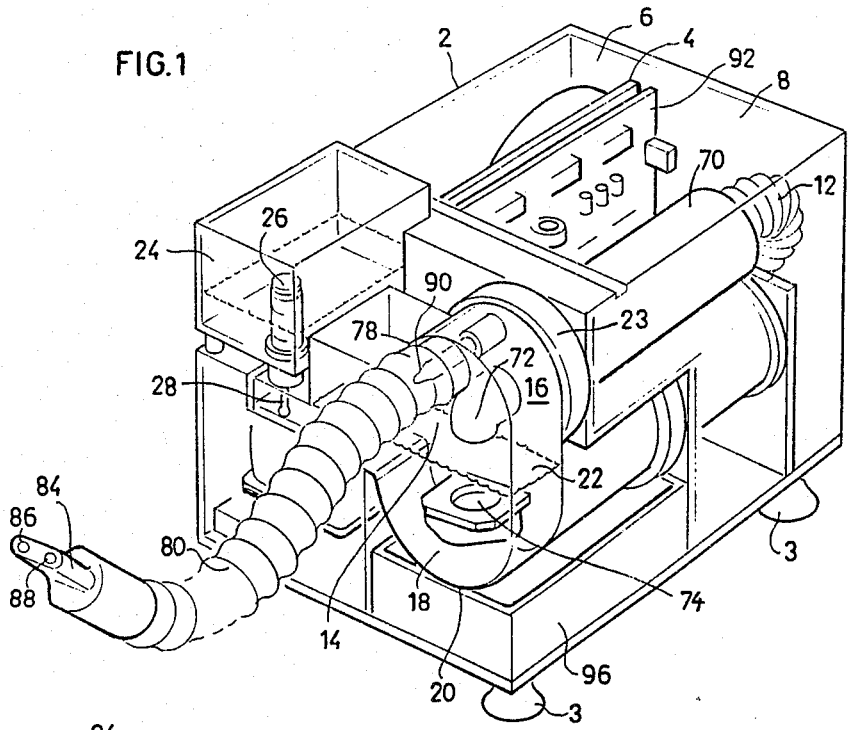
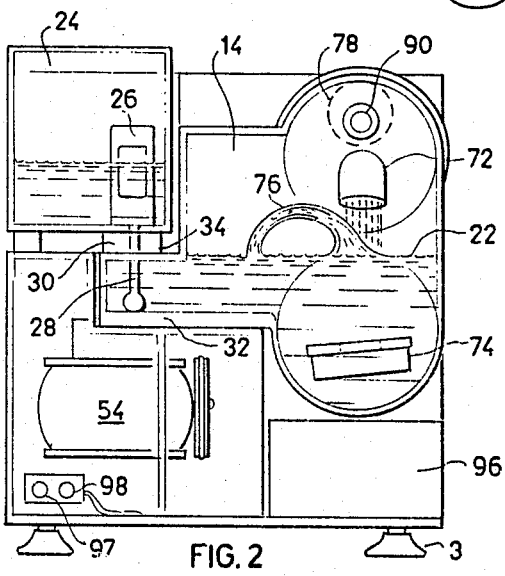
FIG. 2
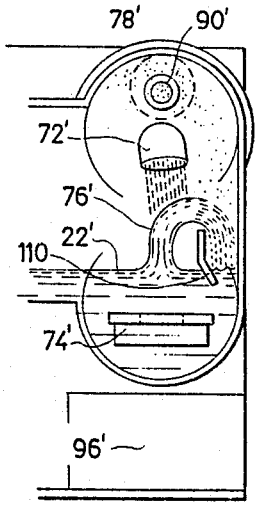
FIG. 5

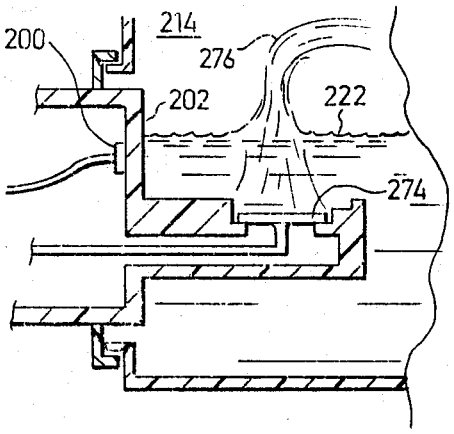
FIG 6
FIG 7
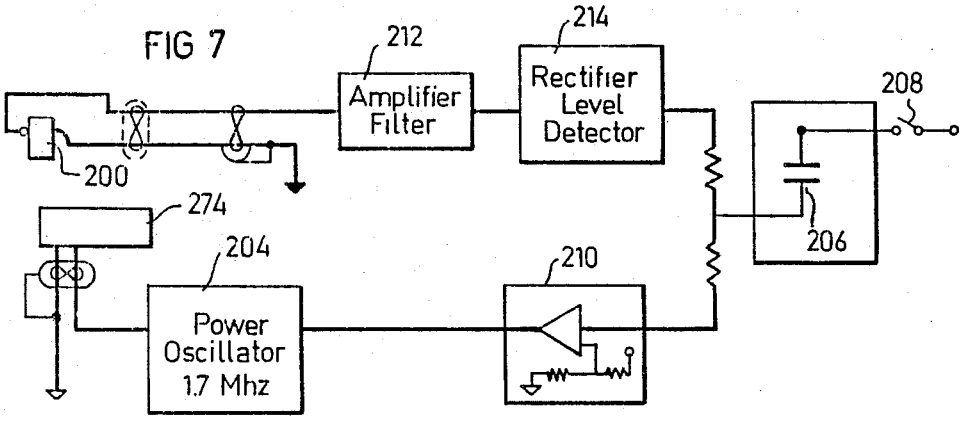
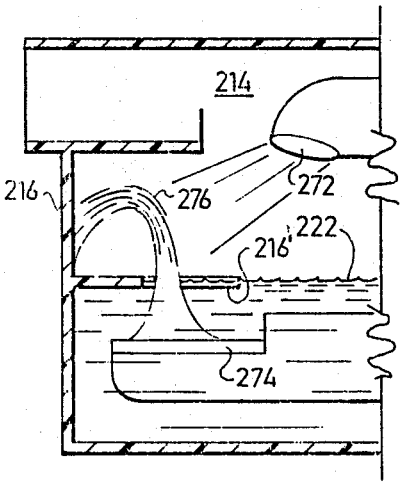
FIG 8
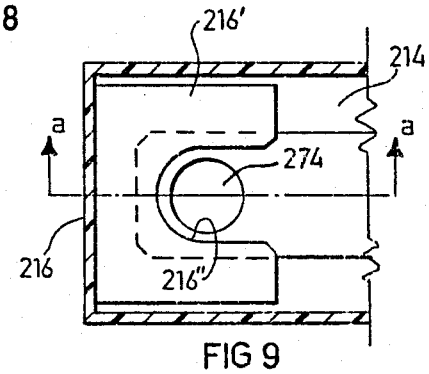
FIG 9

METHOD AND APPARATUS FOR NEBULIZING A LIQUID

RELATED APPLICATION

The present application is a continuation-in-part of application Ser. No. 06/890,037 filed July 28, 1986, now abandoned.

BACKGROUND OF THE INVENTION

The present invention relates to a method and apparatus for nebulizing a liquid. The invention is particularly applicable for use in producing a stream of heated vapor containing liquid droplets to be used for therapeutic purposes, and is therefore described below with respect to this application.

It has recently been shown that the application of a stream of heated vapor to the nasal passages can have a beneficial therapeutic effect on persons suffering from a common cold and other similar ailments, such as sinusitis, allergic and non-allergic rhinitis, nasal polyps, asthma and hay fever. Several patents, for example U.S. Pat. Nos. 4,369,777 and 4,401,114, have issued describing this treatment, and machines are now commercially available for providing this treatment. However, while the treatment has been found to be very effective, the machines now in use are large and noisy, tend to overheat at the entrance to the nostrils, tend to produce considerable water splash, are frequently unreliable, and are very expensive.

A number of prior patents describe a method of nebulizing a liquid by operating an ultrasonic generator, such as a piezoelectric crystal, while submerged in a pool of a liquid to be nebulized. This produces a spout of intensely-agitated liquid spouting upwardly out of the surface of the liquid pool. Examples of patents describing this technique are Gauthier et al. U.S. Pat. No. 3,387,607, Boucher U.S. Pat. No. 3,5561,444, Weaver et al. U.S. Pat. No. 3,593,712, Mitsui U.S. Pat. No. 3,901,443, Nishikawa et al. U.S. Pat. No. 4,410,139, and German Pat. No. DE 3049244. Mitsui U.S. Pat. No. 3,901,443 is of particular interest since it discloses that mounting the ultrasonic generator at an inclination of $2^0$–$22^0$ with respect to the surface level of the liquid was found to increase the nebulizing capacity of the device; and Nisikawa et al. U.S. Pat. No. 4,410,139 is also of particular interest since it discloses that providing a partition surrounding the spout in order to separate the larger non-vaporized particles from the spout base reduces the disturbance to the formation of the spout at the spout base.

Various means are also described in the prior patents for protecting the ultrasonic generator should the level of the liquid fall below a predetermined level.

An object of the present invention is to provide an improved method and apparatus for nebulizing a liquid in a manner which substantially increases the nebulizing capacity and also minimizes the disturbance to the formation of the spout by the fall-back of droplets from the spout into the liquid pool.

Another object of the invention is to provide a nebulizing method and apparatus which includes an improved liquid-level detector means for preventing damage to the ultrasonic generator should the level of the liquid fall below a predetermined level.

BRIEF SUMMARY OF THE INVENTION

According to the the present invention, there is provided a method and apparatus for nebulizing a liquid by operating an ultrasonic generator while submerged in a pool of a liquid to be nebulized to produce a spout of intensely-agitated liquid spouting upwardly out of the surface of the liquid pool. The novel method and apparatus are characterized by directing a confined stream or jet of hot gas preheated to a temperature of at least 250° C. to impinge the spout at an angle to the spout axis and with sufficiently high velocity to deflect the upper portion of the spout laterally of its base at the liquid level and thereby to impart an arcuate trajectory to the spout. In this manner, the rate of nebulization from the spout is increased by: (a) the increased area of contact of the spout, because of its arcuate trajectory, with the gas in the jet; (b) the increased rate of contact of the spout with the gas in the jet because of its high velocity; and (c) the reduced disturbance to the formation of the spout at the spout base because of the shifting laterally with respect to the spout base of the fall-back into the pool of larger liquid droplets from the spout.

Preferably, the confined stream of gas directed to impinge the spout has a velocity of at least 75 cm per second. In the preferred embodiments described below, the jet velocity is approximately 125 cm per second.

According to further features in the described preferred embodiments, the nebulized liquid is outletted from the chamber in the form of a confined stream of hot gas saturated with vapor and having a small quantity of liquid droplets mixed therein, also, the jet of gas impinging the spout is directed into the chamber at a rate to produce a pressure of 5–20 cm, preferably 10 cm, water above atmosphere in the confined stream of gas outletted from said chamber.

In one described embodiment, the disturbance to the formation of the spout at the spout base by the fall-back into the pool of unvaporized liquid droplets is further reduced by providing a divider wall laterally of the ultrasonic generator to separate the larger unvaporized liquid droplets from the spout base. In a second described embodiment, this disturbance is further reduced by providing, laterally of the spout base, a wall having a first surface located to be unwetted by the liquid in the pool and to be impinged by the liquid droplets of the arcuate spout before falling back into the pool, and a second surface continuous with the first surface and located to be wetted by the liquid in the pool.

According to a further feature of the invention, a sonic detector is located at a predetermined level of the chamber, and the ultrasonic generator is de-energized whenever the liquid level of the chamber drops below the predetermined level as detected by the sonic detector.

Apparatus constructed in accordance with the above features of the present invention has been found to substantially increase the nebulizing capacity of such apparatus, and particularly to provide significant beneficial therapeutic effects on persons suffering from the common cold and other nasal ailments. In addition, such apparatus operates with very little noise, and provides a substantially uniform temperature from the hyper-evaporation chamber to the entrance to the user's nostrils, thereby minimizing the possibility of irritating or damaging the person's nostrils by an unduly high temperature. It has also been found that a significantly higher temperature can be achieved in the stream reaching the nasal mucosa, without undue discomfort to the user. Further, the stream of vapor is sufficiently moist to keep the nasal tissues moist, and thereby to minimize irritation or damage, but not so moist as to produce water splash. Still further, such apparatus has been found to be very reliable and less expensive than the apparatus now in use.

Additional features and advantages of the invention will be apparent from the description below.

BRIEF DESCRIPTION OF THE DRAWINGS

The invention is herein described, by way of example only, with reference to the accompanying drawings, wherein:

FIG. 1 is a three dimensional view illustrating one form of apparatus constructed in accordance with the present invention;

FIG. 2 is a front elevational view of the apparatus of FIG. 1;

FIG. 5 is a fragmentary view illustrating a variation;

FIG. 6 is a fragmentary view illustrating the provision of a sonic detector for protecting the ultrasonic generator in the event the liquid drops below a predetermined level;

FIG. 7 is a block diagram illustrating the circuit controlled by the sonic detector for protecting the ultrasonic generator; and FIGS. 8 and 9 are fragmentary views illustrating another manner for minimizing the disturbance of the liquid to the formation of the spout, FIG. 8 being a sectional view along line a—a of FIG. 9.

DESCRIPTION OF PREFERRED EMBODIMENTS

The Embodiment of FIGS. 1–4

Figure 3:
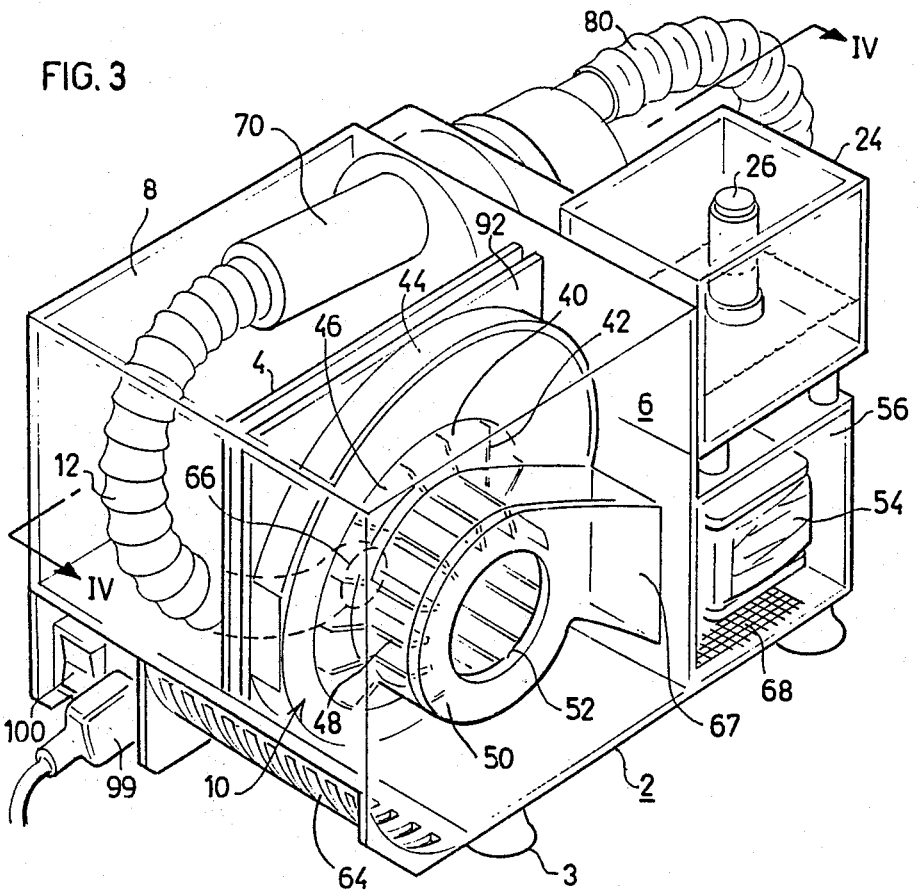
FIG. 3 is a three dimensional view illustrating the apparatus of FIG. 1 from the opposite side.

The apparatus illustrated in the drawings comprises a housing, generally designated 2, of appropriate material such as plastic, supported on rubber feet 3. Housing 2 includes a partition 4 extending the full vertical height of the housing and dividing its rear end into two compartments 6 and 8 each extending the complete vertical height of the housing. A rotary pump, generally designated 10, is disposed within compartment 6 and pumps air to a duct 12 disposed within compartment 8.

Communicating with duct 12 is a chamber 14 located at the front side of the apparatus. Chamber 14 is defined by a vertical rear wall 16 separating the chamber from compartment 8, a front vertical wall 18, a bottom curved wall 20, and a top curved wall 23. Compartment 14 is adapted to receive a quantity of a liquid, namely water in the described preferred embodiment, to a level indicated at 22 in FIG. 1.

The water introduced into compartment 14 is supplied from a water reservoir 24 constructed as a separate container and sealed from the atmosphere except for a valve assembly, generally designated 26, having a depending operator stem 28. Valve assembly 26 is of a known construction and is normally closed, but is automatically opened by its operator stem 28 passing through an inlet port 30 in housing 2 and engageable with a ledge 32 formed in the housing. When reservoir 24 is so applied to housing 2, thereby opening valve 26, the water is automatically fed from reservoir 24 through port 30 into chamber 14 to the level 22, namely the level of the lower face of housing wall 34 formed with the inlet port 30. As also known in valve assemblies of this type, the water is automatically maintained at level 22. Such valves are commonly used in kerosene lamps and the like.

As shown particularly in FIG. 3, pump 10 disposed within compartment 6 is of the rotary type, including a disc 40 formed with a circular array of radially-extending vanes 42 rotatably mounted within a housing 44 fixed to partition 4. Housing 44 is formed with a central opening 46, and vanes 42 include extensions 48 extending through opening 46 into extension 50 of housing 44. Extension 50 is also formed with a central opening 52 communicating with the interior of the pump compartment 6.

Figure 4:
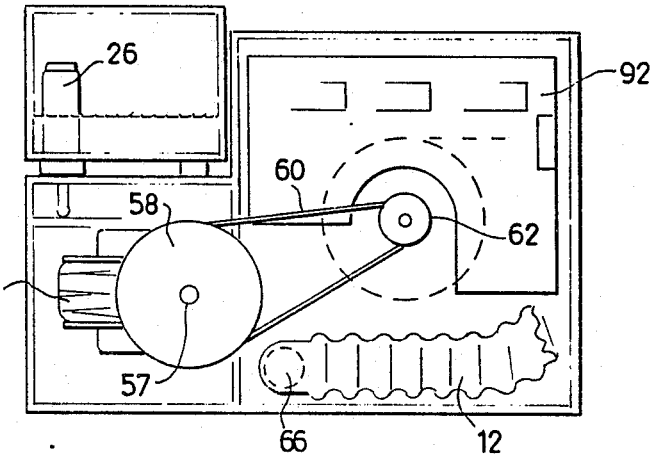
FIG. 4 is a view along lines IV—IV of FIG. 3.

Rotary pump 10 is rotated by an electric motor 54 disposed within a compartment 56 at the front of the apparatus just underlying the liquid reservoir 24. As shown in FIG. 4, motor 52 drives a shaft 57 having a pulley wheel 58 coupled by a pulley belt 60 to another pulley wheel 62 secured to rotatable disc 40 of pump 10. Motor 54 is preferably a shaded-pole induction motor operating at a rotational speed of 3000 RPM when supplied from a 60 cycle power source, and the transmission ratio between pulleys 58 and 62 is such that rotary disc 40 is driven at a speed of 6000 RPM.

Air is inletted into pump compartment 6 via a grill section 64 (FIG. 3) integrally formed with housing 2 at its lower rear end. A porous filter, such as of foam rubber (not shown), may be supported on grill 64 to filter the air inletted into compartment 6. A portion of the air is pumped by pump 10 through an outlet opening 66 formed at the lower end of partition 4 into conduit 12 for conduction by the conduit to the hyper-vaporization chamber 14 at the front end of the apparatus. Another portion of air is pumped by pump 10 via an opening 67 into compartment 56 for cooling the electric motor 54. The latter compartment is also integrally formed with a grill 68 for exhausting this cooling air.

Conduit 12, conducting the air pumped by pump 10 into chamber 14, includes an electrical heater 70 which heats the air passing therethrough so that the air exiting from conduit 12 into chamber 14 is at a high temperature. This air exits from the conduit into chamber 14 via an outlet nozzle 72 oriented so as to direct the heated air downwardly into chamber 14.

Chamber 14 includes an ultrasonic generator 74, in the form of a piezoelectric crystal, disposed within the chamber so as to be submerged by the liquid when received therein to the level 22. Piezoelectric crystal 74 may be of the type commonly used in ultrasonic humidifiers. Preferably, it is operated at a voltage of 120 volts (peak-to-peak) and at a frequency of 1.6 mHz. It agitates the liquid within chamber 14 such as to produce a spout of intensely-agitated liquid spouting upwardly, as shown at 76, out of the liquid surface and falling back by gravity to the liquid surface.

Chamber 14 is provided at its upper end with an outlet 78 connected to one end of a flexible delivery tube 80. The opposite end of delivery tube 80 is closed by a cap 84 formed with a pair of parallel, restricted passageways 86, 88, spaced so as to be alignable with the two nostrils of a user of the apparatus. Outlet 78 and delivery tube 80 thus produce a confined stream of heated air of 100% humidity and including a quantity of water droplets of very small diameter (an average diameter of 4–8 microns), which stream is split into two streams by passageways 86, 88. The two streams enter the two nostrils of the user with sufficient pressure, e.g. 5–20 cm (water), to reach the nasal mucosa without inhalation by the user.

The illustrated apparatus further includes a heat sensor 90 (FIGS. 1, 2) at the outlet end of chamber 14 to measure the temperature thereat. Heat sensor 90 controls heater 70 to maintain a relatively constant temperature at the outlet of chamber 14. Since the air within the chamber is 100% humidified, as described above, there is very little temperature drop in the passage of the heated water vapor stream from chamber 14 via delivery tube 80 to the nostrils of the user.

The temperature of the heated water vapor exiting from chamber 14 is preferably within the range of 40°–55° C.; particularly good results have been obtained when this temperature is 49° C. The delivery tube 80 should be at least 20 cm in length, preferably about 35 cm, which produces a temperature drop of approximately 1.5° C. Another temperature drop of 1°–3° C. may occur during the passage of the vapor stream to the nasal mucosa, depending on whether cap 84 is held against the nostrils, which is comfortably permitted in the illustrated device, or spaced slightly (e.g. 1 cm) therefrom. As described above, heat sensor 90 at the outlet of chamber 14 maintains this temperature relatively constant, and the temperature drop during the travel of the heated stream of air via delivery tube 80 to the nostrils of the user is very low because the heated air is 100% humidified and contains a quantity of water droplets of very small diameter. Heater 70 is preferably operated to produce a temperature of 250°–400° C., preferably 300° C. in the stream of air exiting from nozzle 72 into chamber 14.

The water content of the 100% humidified air outletted from chamber 14 via delivery tube 80 is from 75–90% of the total water content of the stream exiting from that chamber; that is, the water droplet content is from 25–10% of the total water content of this stream. The purpose of the water droplets is to maintain the tissues moist and thereby to prevent irritation or damage. If the water droplet content is less than 10%, it has been found that this unduly irritates the tissues and could even cause damage; whereas if the water droplet content is more than 25%, this makes the treatment less effective and also overly wets the tissues so as to cause water to drip from the nostrils. Best results have been obtained when the total water content of the outletted stream is 80% in the humidified air and 20% in the water droplets. The described apparatus also enables the use of saline water, which is not possible with the existing machines.

The electrical circuit for operating the pump motor 54, heater 70 and the piezoelectric crystal 74 has not been shown, as conventional circuitry may be used for this purpose. Preferably, the components of the electical circuit are carried by a printed circuit board 92 (FIG. 1) directly mounted to partition 4, which partition also mounts the rotary disc 40 of pump 10. Partition 4 is made of aluminum sheet material in order to act as a heat sink for the heat generated by the electrical components mounted on printed circuit board 92.

Cap 84 at the end of delivery tube 80 is preferably removable and replaceable by another cap when the apparatus is to be used by another person. Also, an open-top container 96 is supported by housing 2 to underlie chamber 14 to catch any water drippings, e.g., occurring when the water reservoir 24 is applied. Cap 84, chamber 14, reservoir 24 and delivery tube 80 are all removable for washing.

The front wall of housing 2 includes one or more light indicators for indicating various conditions. Thus, light indicator 97 indicates whether the apparatus is operating, and light indicator 98 indicates a possible malfunction, such as overheating (or underheating) of the heated vapor stream exiting from chamber 14. The apparatus further includes a plug 99 for connecting same to the supply mains, and a switch 100 for turning the apparatus "on" and "off".

OPERATION

The apparatus illustrated in FIGS. 1–4 of the drawings operates as follows:

Removable reservoir 24 is first filled with water. The dimensions of this reservoir are such that it contains a quantity of water sufficient for a standard one-half hour treatment. For filling the reservoir, it is detached from housing 2 and filled through its valve assembly 26 as known in such valve assembly constructions. The reservoir is then inverted to the position illustrated in the drawings and is applied to the upper end of housing 2, with stem 28 of the valve assembly passing through opening 30 in housing wall 34 until the stem engages ledge 32 of the housing. When this occurs, the valve opens and permits the water within it to flow through opening 30 into chamber 14 where it automatically assumes the level indicated at 22 in FIG. 3. This level, which is even with the bottom face of wall 34 in which inlet opening 30 is formed, is automatically maintained during the operation of the apparatus by valve 26 as known in valves of such construction.

Motor 54 is then energized to rotate pump disc 40 via pulley wheels 58, 62 and pulley 60. As indicated earlier, disc 40 is preferably rotated at approximately 6000 RPM. Heater 70 is then energized. A portion of the air inletted into compartment 6 via grill openings 64 is pumped by the vanes on rotary disc 40 into conduit 12 where it is heated by heater 70 and is then directed via outlet 72 downwardly into chamber 14 containing the water to be vaporized. Another portion of the pumped air is passed via opening 67 into compartment 56 to cool motor 54, this part of the air being exhausted via grill openings 68.

At the same time that pump motor 54 and heater 70 are energized, piezoelectric crystal 74 is also energized so as to vibrate at a frequency of 1.6 mHz. As known in conventional humidifiers, this produces in the water within chamber 14, a spout of intensely-agiated water which spouts upwardly, as shown at 76, out of the liquid surface and then falls back by gravity into the water. The water within spout 76, constituted of a multitude of highly agitated small droplets of water, is impinged by the stream of very hot air (at least 250°) outletted from outlet 72 of conduit 12; this hot air instantly vaporizes a portion of the liquid within the spout. The result is that the vapor within chamber 14 is constituted of 100% humidified air containing a small quantity of liquid droplets having an average diameter of 4–8 microns.

The interior of chamber 14 is also pressurized by pump 10 to a pressures 5–20 cm, preferably 10 cm, (water) above atmospheric, so that the vapor within chamber 14 is outletted from outlet 78 into delivery tube 80 in the form of a confined stream of the hot 100% humidified air.

This stream of heated water vapor and water droplets passes through the flexible delivery tube 80 to the cap 82 at the end of the tube. This end is held in contact with, or slightly spaced (no more than 1 cm) from, the user's nose, with openings 86, 88, aligned with the user's nostrils. The heated water vapor exiting from the end of delivery tube 80 is pressurized 5–20 cm, preferably 10 cm, (water) above atmospheric, and therefore the heated water vapor passes into the user's nostril at sufficient velocity to reach the nasal mucosa without inhalation by the user since inhalation is frequently difficult or impossible when the user is suffering from a common cold.

ADVANTAGES OVER KNOWN NEBULIZERS

As indicated earlier, nebulizers are known for use as humidifiers which include ultrasonic generators producing spouts of intensely-agitated liquid. In the present invention, however, a confined stream or jet of hot air, as generated by pump 10 and heated by heater 70, is directed to impinge the spout at an angle to the spout axis, and with sufficiently high velocity, to deflect the upper portion of the spout laterally of its base at the liquid level, where the spout is formed. This imparts an arcuate trajectory to this spout, as shown in FIG. 2 (also in FIGS. 5 and 8 to be described below). Such an arrangement substantially increases the rate of nebulization for the following reasons. First, the arcuate trajectory of the spout increases the area of contact of the spout with the surrounding gas; secondly, the high velocity of the gas in the jet impinging the spout increases the rate of contact of the gas with the liquid particles in the spout; and thirdly, the arcuate trajectory of the spout shifts the fall-back of unvaporized liquid droplets falling back into the pool away from the base where the spout is formed, thereby reducing the disturbance to the formation of the spout at the spout base.

Preferably, the velocity of the jet should be at least 75 cm/second. In the described preferred embodiments, the velocity is approximately 125 cm per second. Also, the temperature of the gas should be at least 250° C.

In addition, the jet of gas impinging the spout is directed into chamber 14 at a rate to produce a pressure of 5–20 cm, preferably 10 cm, water above atmosphere in the confined stream of gas outletted from the chamber via delivery tube 80. Such a pressure is at least one order of magnitude above the pressure increase (about 0.5 cm) in a conventional humidifier of this type.

As shown particularly in FIG. 2, the piezoelectric crystal 74 is mounted at an incline to the vertical axis of chamber 14 so that the axis 77 of the liquid spout 76 as it exits from the surface 22 is at an inclination to the vertical axis of the chamber. While this fact alone increases the nebulizing capacity of the apparatus, as described for example in the above-cited U.S. Pat. No. 3,901,443, the nebulizing capacity is further increased by directing the jet of hot gas from nozzle 78 onto the spout at an angle to the spout axis 77 and with sufficiently high velocity to deflect the upper portion of the spout laterally and to impart the arcuate trajectory to the spout as illustrated in FIG. 2.

MODIFICATION OF FIG. 5

FIG. 5 illustrates a modification wherein the piezoelectric crystal 74' is mounted precisely along the vertical axis to produce a vertical spout 76', but the nozzle 72' is also tilted with respect to the vertical axis of the spout and also discharges a jet of gas against the spout 76' with sufficiently high velocity to deflect the upper portion of the spout and to impart the arcuate trajectory to it.

In addition, the chamber is provided with a divider wall 110 laterally of the spout. The heavier water droplets thus fall back into the pool laterally of the base of the spout, thereby minimizing the disturbance to the formation of the spout above the piezoelectric crystal. The hot stream of air and fine water droplets exit from the chamber via the outlet 78', where sensor 90' is located, whereas the larger droplets fall back into the pool on the side of wall 110 opposite to that where the spout is formed.

MODIFICATIONS OF FIGS. 6 AND 7

FIGS. 6 and 7 illustrate a modification wherein a sonic detector 200, such as a microphone, is used for protecting the ultrasonic generator 274 against damage should the water in chamber 214 drop below a predetermined level. Thus, as shown in FIG. 6, the sonic detector 200 is located on the outer face of a plastic side wall 202 of chamber 214 just below the normal level 222 of the water within the chamber. The spout 276 produced by ultrasonic generator 274 has an arcuate trajectory as described above with respect to FIGS. 2 and 5, this being done by directing a confined stream or jet of very hot gas to impinge the spout at an angle to the vertical axis of the spout and with sufficiently high velocity to deflect the upper portion of the spout laterally of its base.

FIG. 7 is a block diagram illustrating the circuit for energizing and de-energizing the ultrasonic generator 274. The circuit includes a power oscillator 204 driving ultrasonic generator 274 and controlled by a power-on reset capacitor 206 connecting the power oscillator to a power supply via a power switch 208. The power-on reset capacitor 206 maintains a predetermined voltage for a short interval when the power switch 208 is turned on. A threshold detector 210 is interposed between the power-on reset capacitor and the power oscillator 204.

The juncture of the power-on reset capacitor 206 and threshold detector 210 is connected to a circuit including the ultrasonic detector 200, an amplifier-filter for amplifying and filtering the output of detector 200, and a rectifier for rectifying this output. Threshold detector 210 is effective to energize power oscillator 204 to drive the ultrasonic generator 274 only when a predetermined voltage is either present in the power-on reset capacitor 206 or is outputted by the sonic detector 200 via rectifier 214.

The electrical circuit illustrated in FIG. 7 operates as follows: When power switch 208 is turned on by the user, the power-on reset capacitor 206 holds the output high to the threshold detector 210 for a sufficiently long period of time to energize the power oscillator 204 and to drive the ultrasonic generator 274. If the level 222 of the liquid within chamber 214 is above that of the sonic detector 200, the detector will output an electrical signal via the amplifier-filter 212 and rectifier 214 to hold the threshold detector 210 high and thereby to maintain the energization of the power oscillator driving the ultrasonic generator 274. However, if the level of the liquid is below that of sonic detector 200, the sonic detector will not generate the above electrical signal to the rectifier 214, so that as soon as the time interval expires during which the power-on reset capacitor 206 holds the high voltage applied to threshold detector 210, the latter will go low and will thereby deenergize power oscillator 204, terminating the energization of the ultrasonic generator 274.

Preferably, capacitor 206 stores the voltage from the power supply for a period of 100–1,000 milliseconds when the power switch is turned on. In a preferred embodiment, this time period is 400 milliseconds, which is sufficient time for the sonic detector 200 to generate a signal for maintaining the energization of the sonic generator 274, but not sufficient to cause any damage to the ultrasonic generator if the water level is below the level of the sonic detector. If the ultrasonic generator is de-energized, it will remain de-energized until the user turns the unit off and then on, using the main power switch. Even then, the oscillator 204 will only remain on if the user has put water into chamber 214 to the level 222.

MODIFICATION OF FIGS. 8 AND 9

FIGS. 8 and 9 illustrate another arrangement, as compared to that illustrated in FIG. 5, for returning the water droplets from the spout 276 to the liquid surface in a manner minimizing the disturbance to the formation of the liquid spout. The arrangement illustrated in FIGS. 8 and 9 includes a vertical wall section 216 laterally of the ultrasonic generator 274 and a horizontal wall section 216' joined at one end to the vertical wall section 216 and formed at its opposite end with a U-shaped slot 216" located so that the edges of the slot straddle the base of the spout 276 formed by the ultrasonic generator 274. Vertical wall section 216 is located so that its surface is not wetted by the water in the pool. Horizontal wall section 216' is located at the water level 222 so that its lower surface is wetted by the water, whereas its upper surface preferably is not wetted by the water.

As in the previously-described arrangements, a jet or confined stream of hot air is discharged from nozzle 272 at an angle to the axis of spout 276 and is of sufficiently high velocity to impart a curved trajectory to the spout as illustrated in FIG. 8, deflecting the upper portion of the spout to impinge the vertical wall section 216. The water flows down that section to the joined horizontal wall section 216', and from there back into the water pool with a minimum of disturbance of the water pool to the formation of the spout.

It will appreciated that while the invention has been described particularly with respect to a therapeutic instrument, the invention could advantageously be used in other applications involving the nebulization of a liquid by an ultrasonic generator. Many other variations, modifications and applications of the invention will be apparent.

What is claimed is:

1. A method of nebulizing a liquid by operating an ultrasonic generator while submerged in a pool of a liquid to be nebulized to produce a spout of intensely-agitated liquid spouting upwardly out of the surface of the liquid pool, characterized in: directing a jet of hot gas preheated to a temperature of at least 250° C. to impinge said spout at an angle to the spout axis and with sufficiently high velocity to deflect the upper portion of the spout laterally of its base at the liquid level and thereby to impart an arcuate trajectory to the spout, whereby the rate of nebulization from the spout is increased by: (a) the increased area of contact of the spout, because of its arcuate trajectory, with the hot gas in the jet; (b) the increased rate of contact of the spout with the hot gas in the jet because of its high velocity; and (c) the reduced disturbance to the formation of the spout at the spout base because of the shifting laterally with respect to the spout base of the fall-back into the pool of larger liquid droplets from the spout.

2. The method according to claim 1, wherein said jet of hot gas directed to impinge said spout has a velocity of at least 75 cm per second.

3. The method according to claim 1, including the further step of outletting from said chamber a confined stream of hot gas saturated with vapor and having a small quantity of liquid droplets mixed therein, said jet of hot gas impinging said spout being directed into said chamber at a rate to produce a pressure of 5–20 cm water above atmosphere in the confined stream of gas outletted from said chamber.

4. The method according to claim 1, wherein the disturbance to the formation of the spout at the spout base by the fall-back into the pool of liquid droplets is further reduced by providing a divider wall laterally of the ultrasonic generator to separate the larger fall-back liquid droplets from the spout base.

5. The method according to claim 1, wherein the disturbance to the formation of the spout at the spout base by the fall-back into the pool of liquid droplets is further reduced by providing, laterally of the spout base, a wall having a first surface located to be unwetted by the liquid in the pool and to be impinged by the liquid droplets of the arcuate spout before falling back into the pool, and a second surface continuous with said first surface and located to be wetted by the liquid in the pool.

6. The method according to claim 1, including the further step of locating a sonic detector at a predetermined level of the chamber, and de-energizing said ultrasonic generator whenever the liquid level of the chamber drops below said predetermined level as detected by said sonic detector.

7. Apparatus for nebulizing a liquid comprising a chamber for receiving a quantity of the liquid to be nebulized and for forming a liquid pool therein, an ultrasonic generator disposed within said chamber to be submerged by the liquid pool, and drive means for driving said ultrasonic generator to produce a spot of intensely-agitated liquid spouting upwardly out of the surface of the liquid pool; characterized in that: said apparatus includes spout deflecting means comprising means producing a jet of gas, a heater for heating said jet of gas to a temperature of at least 250° C., and means directing said jet of hot gas to impinge said spout at an angle to the spout axis and with sufficiently high velocity to deflect the upper portion of the spout laterally of its base at the liquid level and thereby to impart an arcuate trajectory to the spout, whereby the rate of nebulization from the spout is increased by: (a) the increased area of contact of the spout, because of its arcuate trajectory, with the hot gas in the jet; (b) the increased rate of contact of the spout with the hot gas in the jet because of its high velocity; and (c) the reduced disturbance to the formation of the spout at the spout base because of the shifting laterally with respect to the spout base of the fall-back into the pool or larger liquid droplets from the spout.

8. The apparatus according to claim 7, wherein said spout deflecting means produces and directs a jet of hot gas having a velocity of at least 75 cm per second to impinge said spout.

9. The apparatus according to claim 7, further including a delivery tube connected to said chamber for outletting therefrom a confined stream of hot gas saturated with vapor and having a small quantity of liquid droplets mixed therein; said spout deflecting means directing the jet of hot gas into said chamber at a rate to produce a pressure of 5–20 cm water above atmosphere in the confined stream of gas outletted from said chamber via said delivery tube.

10. The apparatus according to claim 7, further including a divider wall laterally of the ultrasonic generator to separate the larger liquid droplets from the spout base and thereby to further reduce the disturbance to the formation of the spout at the spout base by the fall-back into the pool of liquid droplets.

11. The apparatus according to claim 7, further including a wall having a first surface located to be unwetted by the liquid in the pool and to be impinged by the liquid droplets of the arcuate spout before falling-back into the pool, and a second surface continuous with said first surface and located to be wetted by the liquid in the pool, and thereby to further reduce the disturbance to the formation of the spout at the spout base by the fall-back into the pool of liquid droplets.

12. The apparatus according to claim 11, wherein said wall includes a vertical section laterally of the ultrasonic generator and a horizontal section joined at one end to said vertical section and formed at its opposite end with a U-shaped slot located so that its edges straddle the base of the spout formed by the ultrasonic generator.

13. The apparatus according to claim 7, further including a sonic detector located at a predetermined level of the chamber, and an electrical circuit controlled by said sonic detector for deenergizing the ultrasonic generator whenever the liquid level of the chamber drops below said predetermined level as detected by said sonic detector.

14. The apparatus according to claim 13, wherein said electrical circuit includes a power oscillator for driving said ultrasonic generator, an output detector for detecting an output from said sonic detector when the liquid in the container is above the level of the sonic detector, a power-on reset capacitor for maintaining a predetermined voltage for a predetermined time interval when the power is turned on, and control means for energizing said power oscillator only when a predetermined voltage is either present in said power-on reset capacitor or is outputted by said output detector.

15. The apparatus according to claim 14, wherein said power-on capacitor maintains said predetermined voltage for a period of 100–1,000 milliseconds when the power is turned on.

16. Apparatus for nebulizing a liquid, comprising: a chamber for the liquid to be nebulized; an ultrasonic generator disposed within said chamber to be submerged in the liquid to be nebulized and effective, when energized, to nebulize liquid in said chamber; a sonic detector located at a predetermined level of the chamber; and an electrical circuit controlled by said sonic detector for energizing said ultrasonic generator, but automatically de-energizing said ultrasonic generator when the liquid in said chamber is at a level below that of said sonic detector.

17. The apparatus according to claim 16, wherein said electrical circuit includes a power oscillator for driving said ultrasonic generator, an output detector for detecting an output from said sonic detector when the liquid in the chamber is above the level of the sonic detector, a power-on reset capacitor for maintaining a predetermined voltage for a predetermined time interval when the power is turned on, and control means for energizing said power oscillator only when a predetermined voltage is either present in said power-on reset capacitor or is outputted by said output detector.

18. The apparatus according to claim 17, wherein said power-on capacitor maintains said predetermined voltage for a period of 100–1,000 milliseconds when the power is turned on.

* * * * *

UNITED STATES PATENT AND TRADEMARK OFFICE

CERTIFICATE OF CORRECTION

PATENT NO. : 4,776,990

DATED : October 11, 1988

INVENTOR(S) : Nigel Verity

It is certified that error appears in the above-identified patent and that said Letters Patent is hereby corrected as shown below:

On the title page:

In Foreign Application Priority Data add:

August 15, 1985 Canada 488,819

Claim 7, Column 10, line 43, change "spot" to -- spout --

Claim 7, Column 10, line 61, after "pool" change "or" to -- of --

Signed and Sealed this

Thirty-first Day of December, 1991

*Attest:*

HARRY F. MANBECK, JR.

*Attesting Officer*

*Commissioner of Patents and Trademarks*